US006929138B2

(12) United States Patent
Melrose et al.

(10) Patent No.: US 6,929,138 B2
(45) Date of Patent: Aug. 16, 2005

(54) HOT-FILLABLE MULTI-SIDED BLOW-MOLDED CONTAINER

(75) Inventors: David M. Melrose, Auckland (NZ); Paul Kelley, Thurmont, MD (US); Scott Moersdorf, Holland, MI (US)

(73) Assignee: Graham Packaging Company, L.P., York, PA (US)

( * ) Notice: Subject to any disclaimer, the term of this patent is extended or adjusted under 35 U.S.C. 154(b) by 200 days.

(21) Appl. No.: 10/621,059

(22) Filed: Jul. 16, 2003

(65) Prior Publication Data

US 2004/0016716 A1 Jan. 29, 2004

Related U.S. Application Data

(63) Continuation of application No. 10/135,315, filed on Apr. 29, 2002, now abandoned.
(60) Provisional application No. 60/301,200, filed on Jun. 27, 2001.

(51) Int. Cl.[7] ..... B65D 90/02
(52) U.S. Cl. ..... 215/381; 215/382; 215/384; 215/374
(58) Field of Search ..... 215/373, 374, 215/379, 381, 382, 384; D9/559, 560, 561, 546, 557

(56) References Cited

U.S. PATENT DOCUMENTS

| | | | |
|---|---|---|---|
| D189,372 | S | 11/1960 | Adell |
| D213,824 | S | 4/1969 | Luedtke |
| D236,690 | S | 9/1975 | Oliveira et al. |
| 3,923,178 | A | 12/1975 | Welker, III |
| D275,267 | S | 8/1984 | Gautier |
| D275,368 | S | 9/1984 | du Chambon |
| 4,497,855 | A | 2/1985 | Agrawal et al. |
| D285,776 | S | 9/1986 | Kretz |
| 4,749,092 | A | 6/1988 | Sugiura et al. |
| 4,818,575 | A | 4/1989 | Hirata et al. |
| 4,946,053 | A | 8/1990 | Conrad |
| D318,422 | S | 7/1991 | Rumney |
| 5,178,290 | A | 1/1993 | Ota et al. |
| 5,238,129 | A | 8/1993 | Ota |
| D356,737 | S | 3/1995 | Ginsberg |
| D366,416 | S | 1/1996 | Semersky |
| D366,831 | S | 2/1996 | Semersky et al. |
| 5,690,244 | A | 11/1997 | Darr |
| 5,762,221 | A | 6/1998 | Tobias et al. |
| D397,531 | S | 8/1998 | Huff |
| D402,563 | S | 12/1998 | Prevot et al. |
| D402,896 | S | 12/1998 | Conrad |
| 5,866,419 | A | 2/1999 | Meder |
| 5,908,127 | A | 6/1999 | Weick et al. |
| D418,760 | S | 1/2000 | Blank |
| D419,886 | S | 2/2000 | Gans |
| D435,455 | S | 12/2000 | Gans |
| D446,729 | S | 8/2001 | Renella et al. |
| D455,966 | S | 4/2002 | Patterson |
| 2002/0104820 | A1 | 8/2002 | Hong et al. |

FOREIGN PATENT DOCUMENTS

| | | |
|---|---|---|
| WO | WO 00/50309 | 8/2000 |
| WO | WO 00/68095 | 11/2000 |

*Primary Examiner*—Tri M. Mai
(74) *Attorney, Agent, or Firm*—Howson and Howson

(57) ABSTRACT

A plastic blow molded bottle or wide mouth jar useful in containing hot-filled beverages or food products. The container has a multi-sided sidewall which is capable of accommodating vacuum associated with hot filling, capping and cooling of the container, which is reinforced to resist unwanted deformation, and which enables a label to be aesthetically displayed on the container sidewall. To this end, the sidewall comprises a plurality of panels which include outwardly bowed arcuate sections, as-formed, which flatten to accommodate induced vacuum. Thus, a label can be supported on the sidewall with very few voids, or like sunken areas, behind the label to ensure that the label is prominently displayed on the aesthetically appealing novel container configuration.

18 Claims, 5 Drawing Sheets

2
14
12
10
12a
16
18
34
28
44
30
44
32
32
32
36
36
34
38
36
22
38
20a
38
20
2

FIG.3
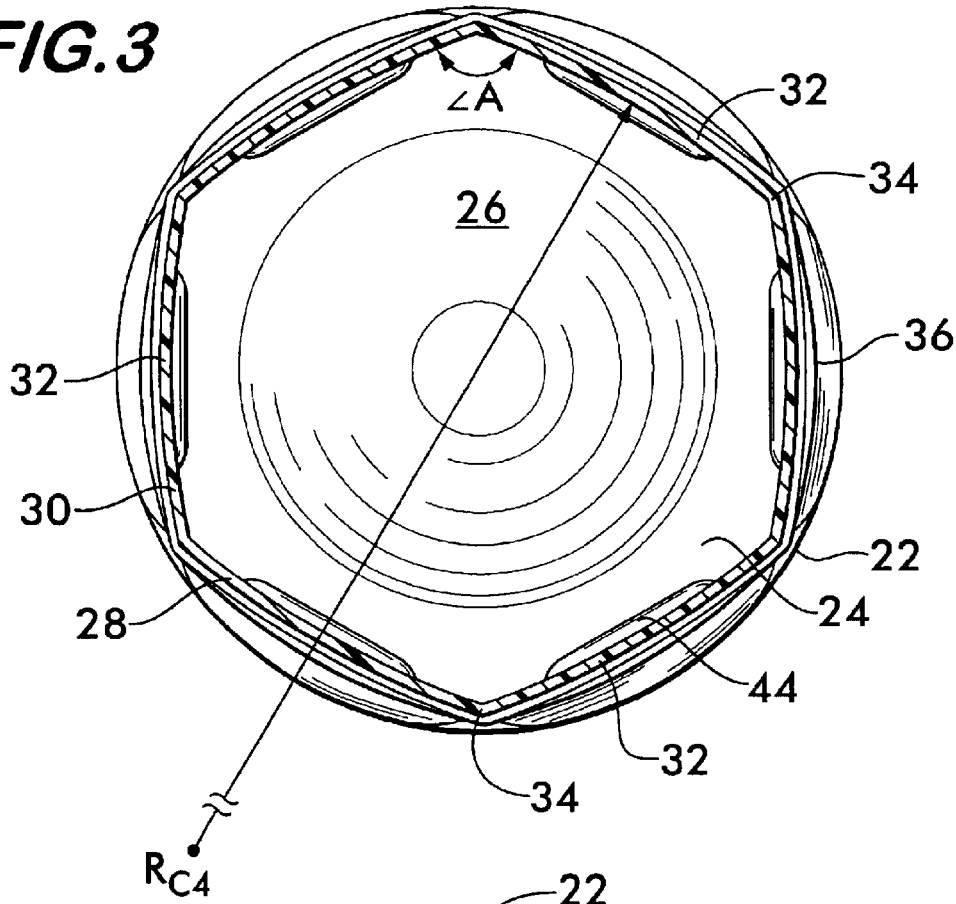
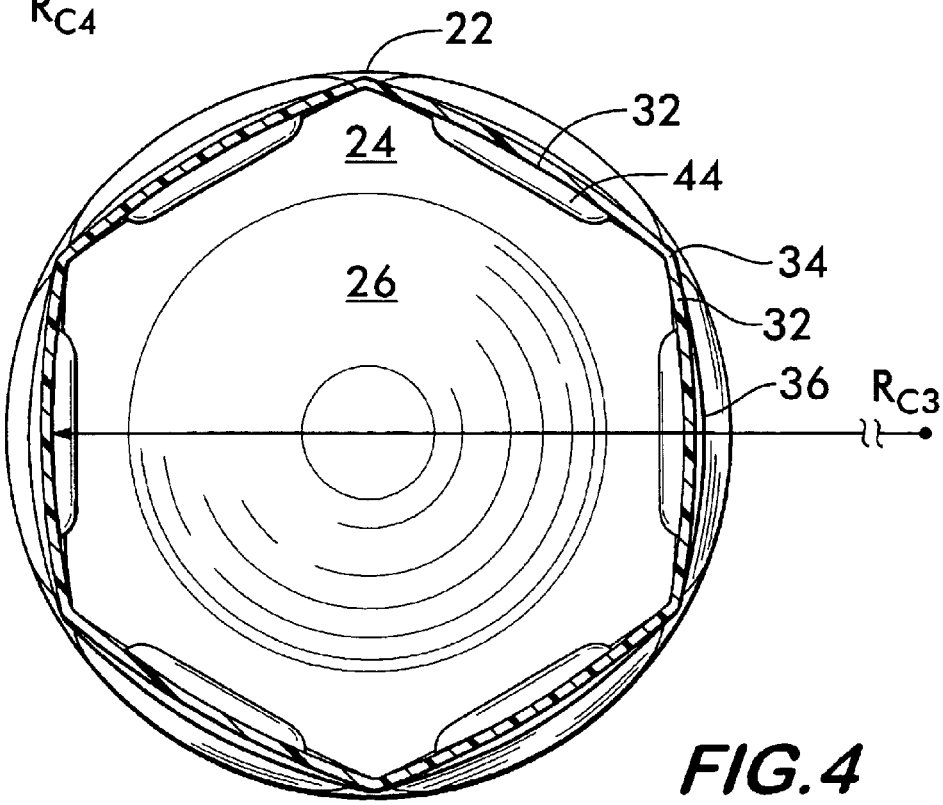
FIG.4

FIG.5
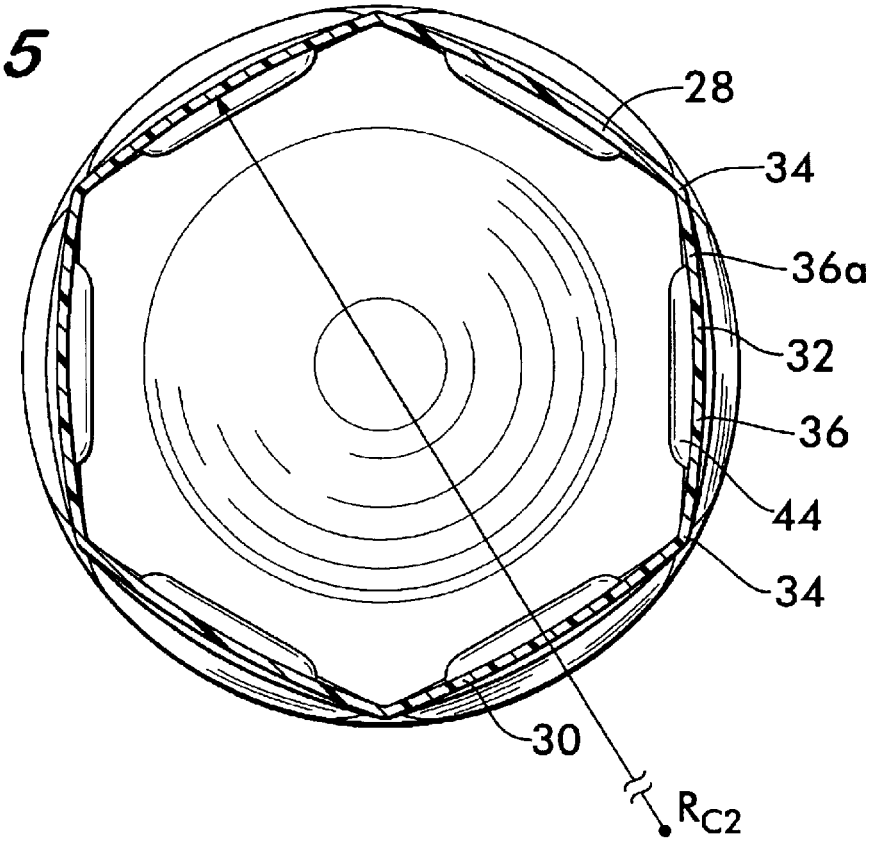
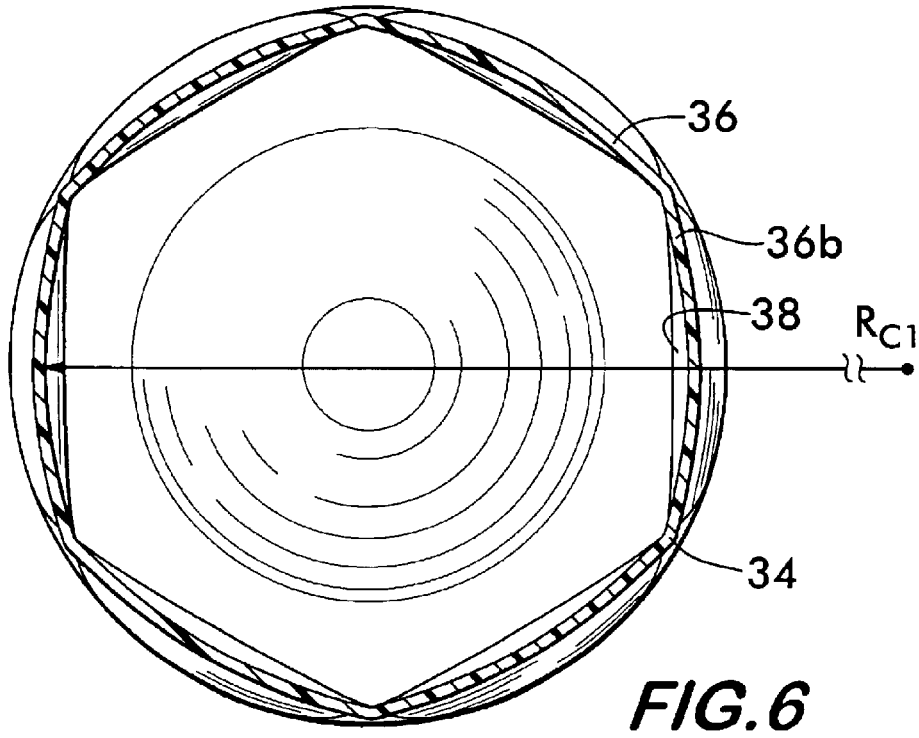
FIG.6

HOT-FILLABLE MULTI-SIDED BLOW-MOLDED CONTAINER

CROSS-REFERENCE TO RELATED APPLICATIONS

This application is a continuation of application Ser. No. 10/135,315, filed Apr. 29, 2002, now abandoned, which claims the benefit of U.S. Provisional Patent Application No. 60/301,200 filed Jun. 27, 2001.

FIELD OF THE INVENTION

The present invention relates to a plastic blow molded bottle or wide mouth jar useful in containing hot-filled beverages or food products, and more particulary, the present invention relates to a container having a multi-sided sidewall which is reinforced to resist unwanted deformation, which enables a label to be aesthetically displayed on the container sidewall, and which is capable of accommodating vacuum associated with hot filling, capping and cooling of the container.

BACKGROUND OF THE INVENTION

Hot-fillable, blow-molded plastic containers are well known in the art. The problems associated with accommodating vacuum deformations associated with hot filling, capping and cooling, and their solutions are also well known. Typically, so-called vacuum flex panels are formed as relatively large indented panels in the sidewall of containers and accommodate the vacuum that develops in the containers as a result of hot fill processing. Examples of cylindrical containers having indented flex panels are disclosed in U.S. Pat. No. 5,762,221 issued to Tobias et al.; U.S. Pat. No. D.402,563 issued to Prevot et el.; U.S. Pat. No. D.366,831 issued to Semersky et al.; and U.S. Pat. No. D.366,416 issued to Semersky.

Hot-fillable blow-molded containers having multi-sided sidewall configurations with indented vacuum flex panels are disclosed, for example, by U.S. Pat. No. 5,178,290 issued to Ota et al. and U.S. Pat. No. 5,238,129 issued to Ota. In particular, FIGS. 7–8 of the Ota '290 patent and FIGS. 5–8 of the Ota '129 patent illustrate and disclose hexagonal and octagonal container sidewall configurations which have indented flex panels.

Hot-fillable, multi-sided containers have also been provided with a series of walls which are formed planar and which bow, flex, or warp inwardly in response to induced vacuum. Thus, the resulting shape of each panel of such hot-filled, capped and cooled containers is concave, or inwardly bowed, thereby providing the sidewall with an undulating shape in plan. Examples of such containers are disclosed by U.S. Pat. No. 4,749,092 issued to Sugiura et al. and U.S. Pat. No. 4,497,855 issued to Agrawal et al. For instance, see FIGS. 2 and 5 of the '092 Sugiura patent and FIG. 7 of the Agrawal '855 patent. U.S. Pat. No. 3,923,178 issued to Welker, III discloses another multi-sided container having a plurality of sidewall panels which, as-formed, are planar and which are designed to flex inwardly. For instance, see FIG. 7 of the Welker, III '178 patent.

Other related container designs are disclosed by U.S. Pat. No. 4,946,053 issued to Conrad which discloses an ovalized label panel for a hot-fillable bottle having a circular footprint; U.S. Pat. No. 5,908,127 issued to Weick et al. which discloses an ovalized or "rounded-off" rectangular sidewall of a hot-fillable bottle having front and rear outwardly bowed panels; and U.S. Pat. No. 5,690,244 issued to Darr which discloses a paneled sidewall of a jar having a circular footprint. Also see the container configurations disclosed in U.S. Pat. No. 4,818,575 issued to Hirata et al.; U.S. Pat. No. 5,866,419 issued to Meder; U.S. Pat. No. D.189,372 issued to Adell; U.S. Pat. No. D.402,896 issued to Conrad; U.S. Pat. No. D.318,422 issued to Rumney; U.S. Pat. No. D.418,760 issued to Blank; and U.S. Pat. No. D.419,886 issued to Gans.

A problem experienced with hot-fillable containers having flex panels, particularly indented or concave flex panels, is that voids are created within the label mounting region behind the labels. Voids behind a label can prevent the label from being prominently displayed on the container sidewall and can provide areas on the label which are prone to tearing, undesirable stretching, or the like. In addition, the use of certain labels, such as shrink wrap labels, can result in the labels extending into, or shrinking within, the voids which also negatively effects container aesthetics.

Another problem experienced with hot-fillable containers is the occurrence of creases, dents or like deformations in the sidewalls of the containers which damage, weaken, and/or detract from the aesthetics of the container. Such deformations can result, for instance, due to line pressure experienced during transferring, filling, capping and packing operations. To this end, adjacent containers in such operations can become tightly engaged, particularly adjacent the base and lower bumper areas of the containers, thereby causing at least selected ones of the containers from being dented or provided with undesirable crease marks. More specifically, multi-sided containers typically experience such deformations adjacent the vertical post structures adjacent the base of the containers.

A still further problem relates to the occurrence of creases, dents or like deformations in the sidewalls of the containers experienced as a result of shipping and handling of the containers due to inadequate top loading or drop capability. To this end, creases or dents can result in containers located in bottom rows of containers on which many other rows of containers are stacked during shipping. In addition, forces exerted on the containers during loading and unloading of the stacked containers can also cause creases and dents. Multi-sided containers are particularly prone to such deformation along post structures adjacent the base of the containers along an area of contact of the containers with adjacent containers in the stack.

Although various ones of the above referenced containers may function satisfactorily for their intended purposes, there is a need for a hot-fillable, blow-molded container having a flex panel and sidewall structure which permits a label to be completely wrapped around the container sidewall and prominently displayed thereon and which limits voids behind the label. In addition, preferably the sidewall structure should be multi-sided and should be reinforced to resist creasing, denting and the occurrence of like deformations. Further, the container should provide improved top loading capability and improved drop testing results. Still further, the container should be capable of efficient and relatively inexpensive manufacture and should be capable of being made from a minimum of thermoplastic material.

OBJECTS OF THE INVENTION

With the foregoing in mind, a primary object of the present invention is to provide a blow-molded plastic bottle and/or wide mouth jar having a multi-sided sidewall capable of accommodating induced vacuum within a hot-filled, capped and cooled container.

Another object of the present invention is to provide a hot-fillable, multi-sided container providing a label mounting area which encompasses flex panel structures on the sidewall and which can prominently support and display a label, including shrink wrap labels and the like.

A further object is to provide a hot-fillable, multi-sided, plastic, blow-molded container which provides a novel visual appearance and which has enhanced structural integrity.

SUMMARY OF THE INVENTION

More specifically, the present invention provides a hot-fillable plastic container provided by a blow molded plastic container body having a circular base, a sidewall, a circular lower bumper between the base and sidewall, and a dome having an upstanding finish. The sidewall has a plurality of panels positioned circumferentially in a side-by-side relationship about the sidewall thereby forming a multi-sided sidewall structure. Each adjacent pair of panels interconnect at an obtuse angle and form a vertically-extending post structure which extends continuously through the multi-sided sidewall structure.

Each panel, as-formed, has a section which is arcuate in a plane extending perpendicular to an imaginary central axis extending longitudinally through the container. The arcuate sections provide the panel with a slightly outward bow and are formed having a predetermined radius of curvature within a predetermined range of radius of curvatures. Preferably, the radius of curvature of the panels varies along the length of the panels. This structure permits the arcuate sections of the panels to flex inwardly for accommodating induced vacuum created when the container is hot-filled, capped and cooled.

Each panel also has an inset circumferentially-extending reinforcement area adjacent the lower bumper of the container. Each inset area extends between an adjacent pair of the post structures and terminates a spaced distance from the post structures to reinforce and strengthen the circular lower bumper and post structures. This structure enables the container to resist creasing, denting and like deformation, and enhances top loading capability and drop testing results.

BRIEF DESCRIPTION OF THE DRAWINGS

The foregoing and other objects, features and advantages of the present invention should become apparent from the following description when taken in conjunction with the accompanying drawings, in which:

FIG. 3 is a cross-sectional view of the container taken transversely through the container along line 3—3 of FIG. 2;

FIG. 3 is a cross-sectional view of the container taken transversely through the container along line 3—3 of FIG. 2;

FIG. 4 is a cross-sectional view of the container taken transversely through the container along line 4—4 of FIG. 2;

FIG. 5 is a cross-sectional view of the container taken transversely through the container along line 5—5 of FIG. 2;

FIG. 6 is a cross-sectional view of the container taken transversely through the container along line 6—6 of FIG. 2.

DETAILED DESCRIPTION OF THE PREFERRED EMBODIMENT

Figure 1:
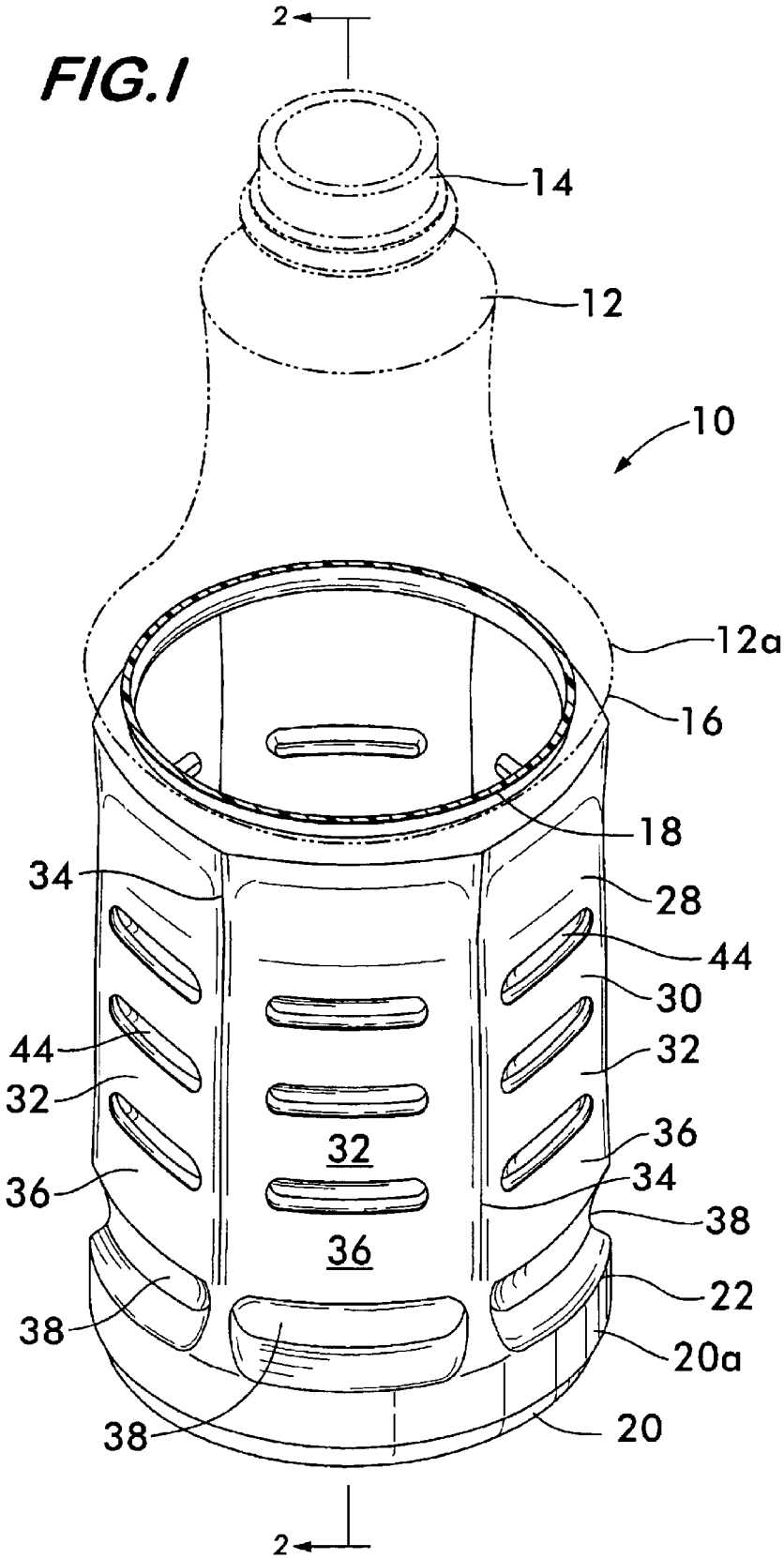
FIG. 1 is a perspective view of a container embodying the present invention with the dome of the container being illustrated in phantom.

An embodiment of a blow-molded plastic container body 10 according to the present invention is illustrated in FIG. 1. The illustrated container body 10 is utilized to package beverages, such as juice, and is capable of being filled in either high-speed hot-fill or cold fill operations. The container 10 can be manufactured in various sizes to provide a fill capacity of, for instance, 64 fluid ounces. Of course, the container 10 can be made smaller, or larger, to provide any desired pre-determined capacity and also can be made having a wide-mouth finish so that the container can be utilized as a jar to package food products, such as, sauces, relishes, pickles, and the like.

Figure 2:
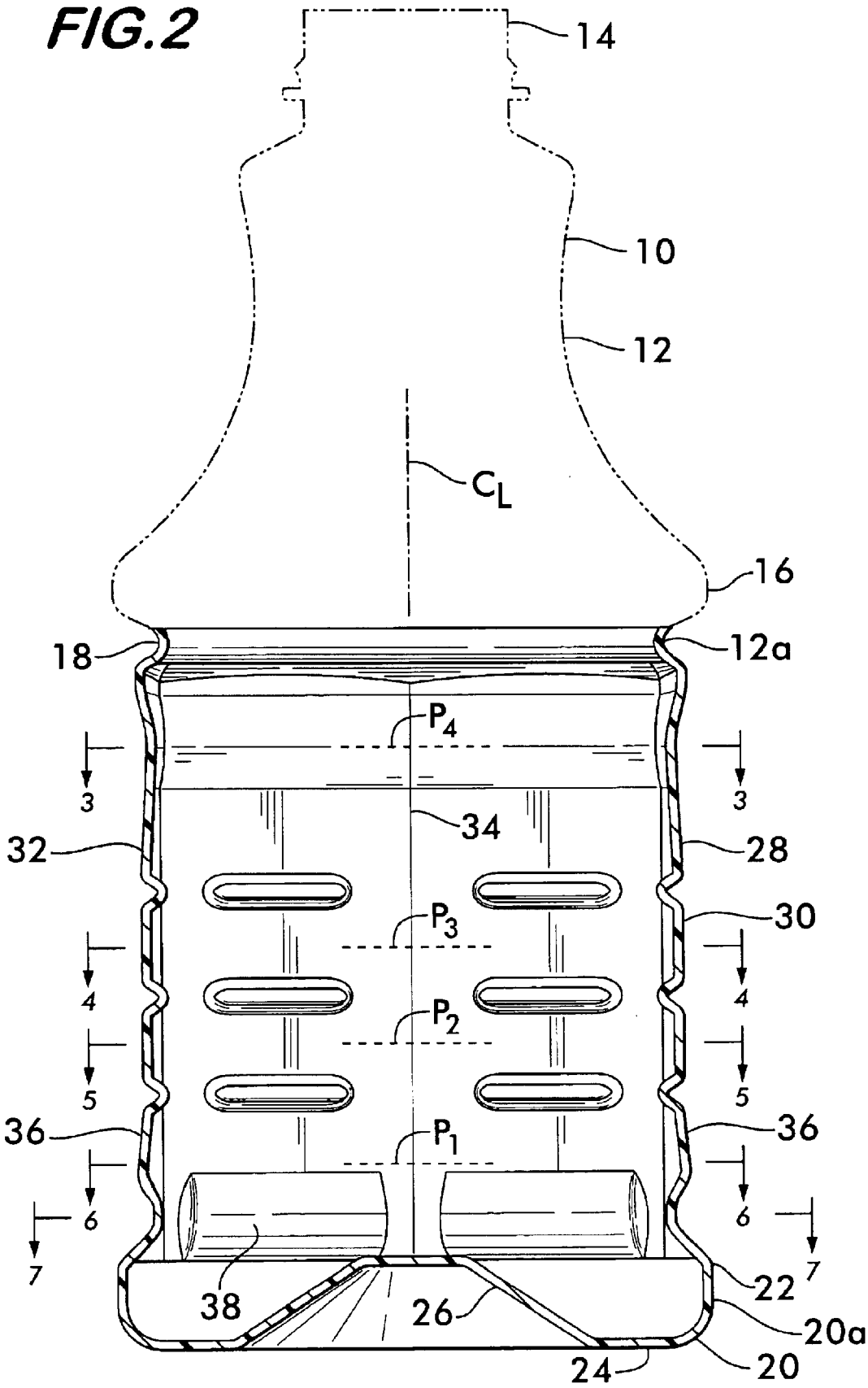
FIG. 2 is a cross-sectional view of the container illustrated in FIG. 1 taken longitudinally of the container along line 2—2.

As best illustrated in dashed lines in FIGS. 1 and 2, the container body 10 has a dome 12 with an upstanding finish 14. The particular shape of the dome can vary as desired. In the illustrated embodiment, the dome 12 has a lower end 12*a* providing an upper label bumper 16 which is circular and which projects outwardly directly above an inset circumferential groove 18. The groove 18 provides hoop strength and resists ovalization-type distortion of the container body 10. Preferably, the finish 14 is provided in narrow sizes for beverage bottle-type containers and is provided in wide-mouth sizes for jar-type food containers. In addition, the finish 14 can be an injection molded finish or a blown finish and is preferably provided with threads for cooperatively engaging a cap (not shown) used to seal the container body 10.

Preferably, a closed ended base 20 provides the container body 12 with a circular footprint. An outer peripheral sidewall 20*a* of the base 20 provides a lower label bumper 22 which, as illustrated, is circular. An endwall 24 of the base 20 can be of any desired shape, such as, a concave-shaped base structure 26 as shown in FIG. 2. To this end, the base 20 is a so-called push-up style base and is capable of accommodating a percentage of the induced vacuum created in a hot-filled, capped and cooled container.

One important aspect according to the present invention is that the container body 10 has a multi-sided sidewall 28 which extends between the dome 12 and base 20. In the illustrated embodiment, the entire sidewall 28 is multi-sided and provides a label mounting region 30 extending between the upper and lower label bumpers, 16 and 22. Alternatively, although not illustrated, only a portion of the sidewall 28 need be formed as a multi-sided structure, and the label mounting region can be limited to less than the entire sidewall 28.

In the preferred embodiment, a label (not shown) can be applied to the sidewall 28 to cover the entire sidewall 28 and extend 360° about the sidewall 28. For example, the label can be a paper label adhesively applied to the sidewall 28 or a tubular plastic shrink wrap label shrunk to tightly engage the sidewall 28. Most importantly, the container body 10 is capable of prominently displaying these and other types of labels because the sidewall 28 has relatively few voids, or sunken areas, behind the label.

As illustrated, the multi-sided sidewall 28 is formed by six panels 32 positioned in a side-by-side relationship about the periphery of the sidewall 28. Each pair of adjacent panels 32 interconnect at an obtuse angle "A", and a column, or post, 34 is formed at each interconnection. Thus, the illustrated container body 10 has six circumferentially-spaced, longitudinally-extending posts 34. Preferably, each panel 32 is identical in shape and size, and only a corner-shaped post 34 is located between each pair of adjacent panels 32. Alternatively, at least selected ones of the panels can be provided with a different shape and/or dimension, and intermediate structures can be located between each adjacent pair of panels. In addition, the number of panels 32 utilized to form the sidewall can vary, such as within a range of 3 to 12 panels.

Preferably, each panel 32 has at least a section 36 thereof which is flexible to accommodate induced vacuum created in a hot-filled, capped and cooled container. In accordance with the objectives of the present invention to reduce the number of voids or the like behind a label and to enhance the prominence of the display provided by the label, the flexible sections 36 are not formed as indented structures. Rather, the flexible sections 36 of the panels 32 are formed with a slight gentle outward bow between each pair of adjacent posts 32. For example, as illustrated in FIG. 6, the section 36 is arcuate in a plane "$P_1$" extending perpendicular to an imaginary central axis "$C_L$" of the container body 10 and is formed at a predetermined radius of curvature "$Rc_1$". Also see the cross-sections of the panels 32 which are illustrated in FIGS. 3, 4, and 5 along planes "$P_4$", "$P_3$" and "$P_2$", respectively, and which are formed at predetermined radius of curvatures "$Rc_4$", "$Rc_3$" and "$Rc_2$", respectively.

When the container body 10 is hot-filled and capped and as the hot-filled container body 10 and its contents cool, a vacuum is created which reduces the internal volume of the sealed container. The outwardly bowed sections 36 of the panels 32 of the container body 10 accommodate the vacuum by flexing inwardly to a substantially flattened condition. Thus, the sidewall 28 of the hot-filled, capped and cooled container body 10 maintains a uniform multi-sided configuration and is capable of prominently displaying a label.

According to one contemplated embodiment of the present invention, the outward bow of the flexible sections 36 of the panels 32, as-formed, becomes either greater, or gentler, as the panel extends in a direction parallel with the central axis "$C_L$". For example, section 36 of each panel 32 bows outward to a greatest extent in plane "$P_1$" and flattens as the panel 32 extends upwardly toward plane "$P_4$". To this end, sections 36*a* illustrated in FIG. 5 are flatter and have a greater radius of curvature than sections 36*b* illustrated in FIG. 6. Preferably, the radius of curvature "$Rc_1$" defines a minimum radius of curvature of the section 36 of the panel 32, and the radius of curvature "$Rc_2$" defines a maximum radius of curvature. In addition, preferably the minimum and maximum radius of curvatures are within 5% of one another so that the change in radius of curvature, if any, is gentle and difficult to visualize.

As an alternative to the above discussed and illustrated structure of the flexible sections 36 of the panels 32, the entire flexible section 36, or each entire panel 32, can be formed having a constant radius of curvature. Another alternative is for the sections 36 to flatten as the sections 36 extend in a direction toward the base 20. Yet another alternative is a flexible section 36 which is provided with upper and lower arcuate areas and a relatively flat intermediate area located therebetween (ie. a so-called "H-panel" structure).

An advantage of providing a multi-sided sidewall 28 having panels 32 which flex inwardly according to the present invention is that as the panels accommodate vacuum they are also reinforcing the post strength of the sidewall 28 by pinching, and preferably vertically-straightening, the posts 34 formed at the interconnection of each adjacent pair of panels 32. For instance, the obtuse angle "A" of the interconnection between adjacent panels 32, as formed, reduces as the outwardly bowed flexible sections 36 flatten. Thus, the posts 34 progressively become stiffer as the sidewall 28 accommodates the induced vacuum and provides the filled and sealed container body 10 with improved top-loading capability.

Preferably, the posts 34 on the multi-sided sidewall 28 are continuous and without interruption thereby maximizing top-loading capability of the container body 10. In addition, preferably at least a portion of each post 34 is located adjacent an inset reinforcement area, or rib, 38. The ribs 38 are located on each panel 32 adjacent areas of the posts 34 that tend to crease or dent due to line pressures which are experienced during transferring, filling, capping, and packing operations and which result in adjacent containers being forced tightly together in a restricted amount of space.

Figure 7:
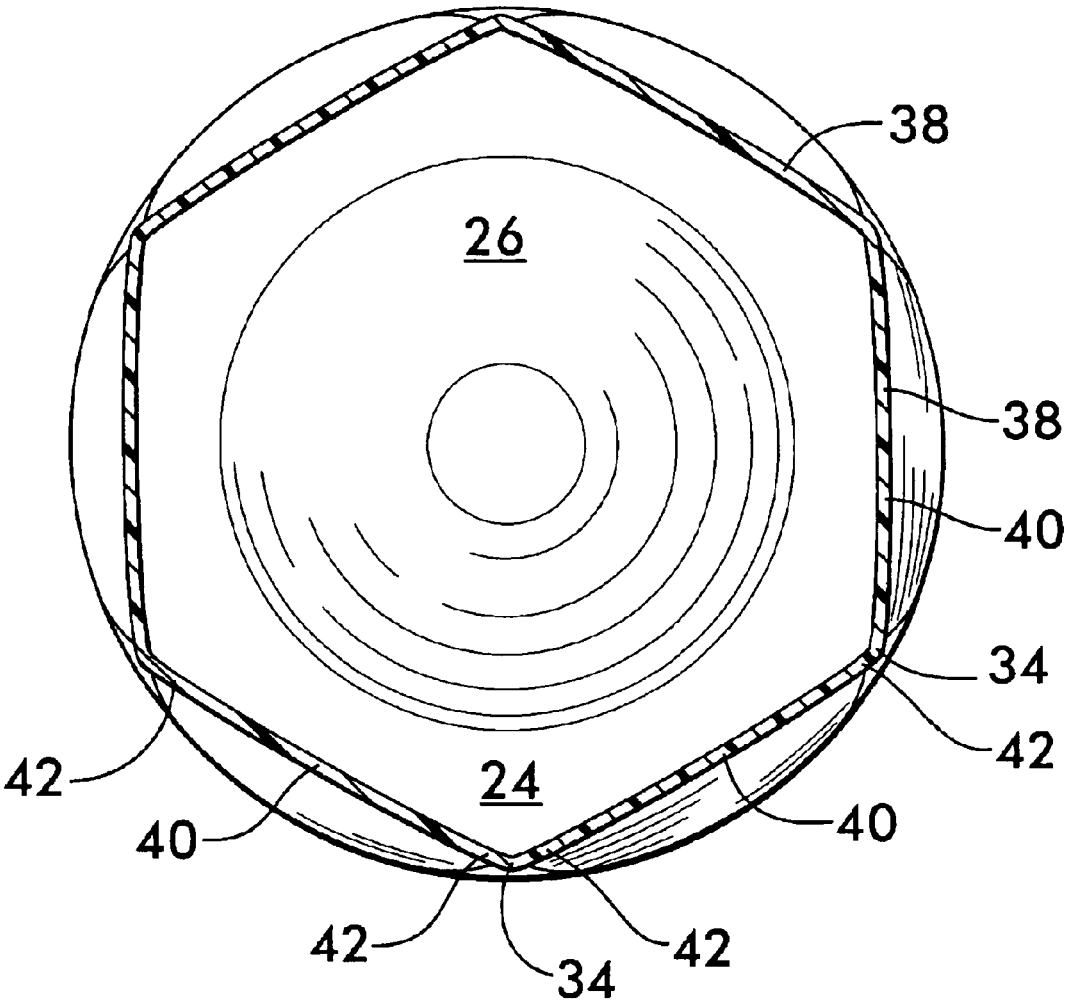
FIG. 7 is a cross-sectional view of the container taken transversely through the container along line 7—7 of FIG. 2.

Preferably, one circumferentially-extending rib 38 is located on each panel 32 between and adjacent the lower label bumper 22 and the flexible sections 36 of the panels 32. As best illustrated in FIG. 7, each rib 38 extends between an adjacent pair of posts 34 and does not interrupt the posts 34 to permit the posts 34 to extend continuously from the groove 18 of the dome 12 to the lower label bumper 22 of the base 20. The ribs 38 function to reinforce and strengthen the lower label bumper 22 and the posts 34 and to prevent deformation thereof. In addition, the ribs 38 permit the arcuate flexible sections 36 to flatten, yet reinforce the sections 36 from unwanted inward denting and like deformation. Thus, creasing and like deformations which structurally weaken and blemish the aesthetics of the container body 10 are prevented at locations particulary susceptible to such deformations.

By way of example and not by way of limitation, the container body 10 is manufactured of PET utilizing injection blow-molding techniques. Of course, other plastic materials and multi-layered plastic materials can be utilized as well as other blow molding techniques. The container body 10 is dimensioned to have a capacity of 64 fluid ounces and a multi-sided sidewall with a total of six identical panels 32. Each panel 32 has a flexible section 36 which, as formed, bows outwardly. A lower portion of the flexible section 36 has a radius of curvature of about 5.5 inches and an upper portion of the flexible section has a radius of curvature of about 5.7 inches. The sidewall 28 has six vertically extending posts 34, and each panel 32 has one circumferentially extending inset rib 38 which is located between and adjacent the lower label bumper 22 and the flexible sections 36. Each rib 38 terminates a spaced distance from an adjacent pair of posts 34, and preferably the innermost walls 40 of the ribs 38 are planar as illustrated in FIG. 7 and have ends 42 which interconnect to form a portion of the posts 34. In addition, preferably the upper and lower label bumpers 16 and 22 are circular in plan and the base 20 of the container body 10 provides a circular footprint. Finally, each panel 32 has three longitudinally-spaced, circumferentially extending inset reinforcement ribs 44 which prevent unwanted over flexure of the panels 32 and assures that the panels 32 uniformly accommodates the induced vacuum.

While a preferred hot-fillable container body having a multi-sided sidewall has been described in detail, various modifications, alterations and changes may be made without departing from the spirit and scope of the present invention as defined in the appended claims.

What is claimed is:

1. A hot-fillable plastic container, comprising:

a blow molded plastic container body having a base, a finish opposite said base, and a sidewall extending therebetween;

a portion of said sidewall having a plurality of panels positioned circumferentially about said sidewall portion to form a multi-sided sidewall structure;

each adjacent pair of said panels interconnecting to form an angle therebetween and to form a continuous longitudinally-extending post structure therebetween; and at least selected ones of said panels having a section thereof formed outwardly bowed of the container at a radius of curvature within a predetermined range of radius of curvatures;

said radius of curvature of each of said outwardly bowed sections extending on a plane perpendicular to an imaginary central axis extending longitudinally through the container; and said radius of curvature of each outwardly bowed section varying as said outwardly bowed section extends in a direction parallel to said imaginary central axis;

whereby, when the container is hot-filled and capped and as the hot-filled and capped container is permitted to cool, said outwardly bowed section flattens to accommodate induced vacuum created within the capped and filled container.

2. A hot-fillable plastic container according to claim 1, wherein said sidewall has an outwardly extending, circumferentially-disposed, circular bumper.

3. A hot-fillable plastic container according to claim 2, wherein at least selected ones of said panels have an inset reinforcement area adjacent said bumper, each of said inset areas extending between an adjacent pair of said post structures and terminating a spaced distance from said post structures, whereby said inset areas function to reinforce and strengthen said bumper and post structures to prevent deformation thereof.

4. A hot-fillable plastic container according to claim 3, wherein said bumper is a lower label bumper located adjacent said base, and wherein said outwardly bowed sections of said panels are located above said inset areas.

5. A hot-fillable plastic container according to claim 3, wherein said sidewall portion includes at least five panels each having an as-formed outwardly bowed section and an inset reinforcement area.

6. A hot-fillable plastic container according to claim 5, wherein said sidewall portion is formed from six identical panels positioned side by side.

7. A hot-fillable plastic container according to claim 1, wherein said outwardly bowed sections of said panels flex inwardly when said container is hot-filled and capped and as the hot-filled and capped container is permitted to cool to accommodate induced vacuum created within the capped and filled container.

8. A hot-fillable plastic container according to claim 1, wherein said angle formed between each adjacent pair of said panels is obtuse.

9. A hot-fillable plastic container according to claim 1, wherein said base is circular.

10. A hot-fillable plastic container according to claim 1, wherein said radius of curvature of each outwardly bowed section increases as said outwardly bowed section extends toward said finish.

11. A hot-fillable plastic container according to claim 1, wherein said radius of curvature of each outwardly bowed section decreases as said outwardly bowed section extends toward said finish.

12. A hot-fillable plastic container according to claim 1, wherein said range of radius of curvatures includes a maximum radius of curvature and a minimum radius of curvature, and wherein said maximum radius of curvature is within 5% of said minimum radius of curvature.

13. A hot-fillable plastic container according to claim 1, wherein said sidewall portion having said panels provides a label mounting area, and wherein said sidewall includes a circular upper label bumper above said label mounting area and a circular lower label bumper below said label mounting area.

14. A hot-fillable plastic container according to claim 1, wherein said finish is selected from the group consisting of an upstanding threaded narrow neck finish, an upstanding threaded wide mouth finish, an upstanding injection molded finish, and an upstanding blown finish.

15. A hot-fillable plastic container, comprising:

a blow molded plastic container body having a circular base, a sidewall, a circular lower bumper between said base and sidewall, and a dome having an upstanding finish opposite said base;

said sidewall having at least five panels positioned circumferentially in a side-by-side relationship about said sidewall thereby forming a multi-sided sidewall structure;

each adjacent pair of said panels interconnecting to form an obtuse angle therebetween and a vertically-extending post structure which extends continuously through said multi-sided sidewall structure; and each panel, as-formed, having a section which is arcuate in a plane perpendicular to an imaginary central axis extending longitudinally through the container, each arcuate section providing said panel with a slightly outward bow and having a predetermined radius of curvature within a predetermined range of radius of curvatures, and said radius of curvature of said arcuate sections varying as said arcuate sections extend in a direction parallel to said imaginary central axis;

each panel having an inset circumferentially-extending reinforcement area adjacent said lower bumper, each of said inset areas extending between an adjacent pair of said post structures and terminating a spaced distance from said post structures to reinforce and strengthen said circular lower bumper and post structures, and each of said arcuate sections of said panels flexing inwardly for accommodating induced vacuum created when the container is hot-filled, capped and cooled.

16. A hot-fillable plastic container according to claim 15, wherein said radius of curvature of said arcuate sections decreases as said arcuate sections extend toward said base.

17. A hot-fillable plastic container according to claim 15, wherein said radius of curvature said arcuate sections increases as said arcuate sections extend toward said base.

18. A hot-fillable plastic container according to claim 16, wherein said range of radius of curvatures includes a maximum radius of curvature and a minimum radius of curvature, and wherein said maximum radius of curvature is within 5% of said minimum radius of curvature.

* * * * *